United States Patent [19]

Inaba et al.

[11] 4,031,811

[45] * June 28, 1977

[54] ELECTRO-HYDRAULIC PULSE MOTOR

[75] Inventors: Seiuemon Inaba; Kanryo Shimizu, both of Kawasaki; Kohei Ito, Fujisawa; Youichi Amemiya; Gotaro Gamo, both of Tokyo, all of Japan

[73] Assignee: Fujitsu Ltd., Japan

[ * ] Notice: The portion of the term of this patent subsequent to May 28, 1992, has been disclaimed.

[22] Filed: Jan. 19, 1972

[21] Appl. No.: 219,087

[30] Foreign Application Priority Data

Jan. 29, 1971 Japan ..... 46-3337[U]

[52] U.S. Cl. ..... 91/39; 91/180; 91/380; 91/503; 91/451

[51] Int. Cl.² ..... F15B 9/10; F01B 3/10

[58] Field of Search ..... 91/429, 380, 39, 180, 91/503, 451, 420

[56] References Cited

UNITED STATES PATENTS

| | | | |
|---|---|---|---|
| 2,395,671 | 2/1946 | Kleinhans et al. | 91/439 |
| 2,598,180 | 5/1952 | Kenyon | 91/439 |
| 3,006,323 | 10/1961 | Tilney | 91/420 |
| 3,158,068 | 11/1964 | Bakelman | 91/439 |
| 3,473,443 | 10/1969 | Mikkelsen | 91/451 |
| 3,621,762 | 11/1971 | Ikebe et al. | 91/380 |

*Primary Examiner*—Paul E. Maslousky
*Attorney, Agent, or Firm*—Allan Ratner

[57] ABSTRACT

This disclosure relates to an improved electro-hydraulic pulse motor wherein safety valves are arranged in hydraulic circuits provided for the hydraulic motor part of an electro-hydraulic pulse motor so as to release abnormal high pressure produced in the circuits due to sudden interruption of the operation of an electric pulse motor part of the electro-hydraulic pulse motor. As a result, breakage of the circuits or four way pilot valve part of the electro-hydraulic pulse motor can be avoided.

2 Claims, 3 Drawing Figures

ELECTRO-HYDRAULIC PULSE MOTOR

DISCLOSURE OF THE PRESENT INVENTION

The present invention relates to an improvement of the electro-hydraulic pulse motor.

The electro-hydraulic pulse motor has a conventional arrangement in which the principal parts thereof consisting of an electric pulse motor, a rotary type four way pilot valve and an axial piston hydraulic motor, are operatively coupled to each other by a reduction gear and a screw-nut coupling having feedback operation and forming a feedback loop in the hydraulic circuit of the electro-hydraulic pulse motor.

The above-mentioned conventional electro-hydraulic pulse motor works on an operational principle such as disclosed below.

A predetermined amount of rotation of the electric pulse motor shaft in response to the impression of an electric pulse or of electric pulse train to the input of the electric pulse motor, is transmitted to the valve spool of a four way pilot valve part by way of a reduction gear so as to cause rotation of the valve spool.

The rotation of the valve spool is transformed into an axial shift of the valve spool by the above-mentioned screw-nut coupling and the axial shift of the valve spool from the initial neutral position opens an oil supply passage provided in the four way pilot valve part so as to introduce hydraulic pressure fluid from a fluid power source into the hydraulic circuit for actuating the hydraulic motor part to provide a large torque on the shaft of the hydraulic motor part which serves also as the output shaft of the electro-hydraulic pulse motor, the output being used for driving e.g. a machine on the one hand. On the other hand, the output rotation of the hydraulic motor part, restores the valve spool of the four way pilot valve part to the neutral position thereof, where the hydraulic circuit is blocked, again by means of the screw-nut coupling, and one cycle of operation of the electro-hydraulic pulse motor is finished with respect to a pulse input impressed thereto.

In the case where this kind of electro-hydraulic pulse motor is adapted for a drive means connected to one feed-mechanism of a numerically controlled machine tool, it can happen that the electro-hydraulic pulse motor must be suddenly stopped by the numerical controller due to some accident encountered in the operation of the numerically controlled machine tool.

That is to say, impression of the electric pulse inputs applied to the electric motor part is suddenly interrupted, and thus causes undesirable extremely high pressure in the hydraulic circuits upon closure of the four way pilot valve part. This is because compression of the hydraulic fluid remaining in the hydraulic circuits takes place due to the inertial rotation of the hydraulic motor part which continues for a short period after interruption of the rotation of the electric pulse motor part.

The above-mentioned high pressure often causes breakage of the hydraulic circuits or the four way pilot valve part which results in cessation of the electro-hydraulic pulse motor operation and further, the breakage tends to occur more often with increase of the rotational speed of the electro-hydraulic pulse motor.

One object of the present invention is to provide an improved electro-hydraulic pulse motor having safety valve arranged to be connected to the hydraulic circuits of the electro-hydraulic pulse motor so that the hydraulic pressure within the ciruits may be prevented from exceeding a determined maximum value.

The present invention will be more apparent from the ensuing description with reference to the accompanying drawings wherein.

Figure 1:
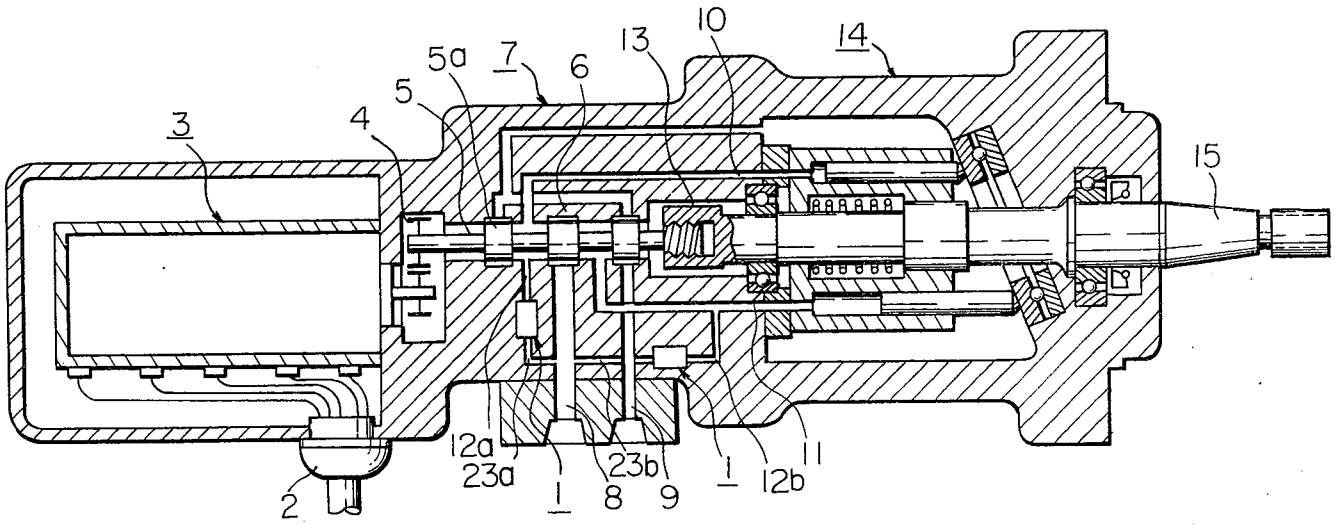
FIG. 1 is a longitudinally sectional view of the electro-hydraulic pulse motor having safety valves according to one embodiment of the present invention.

FIG. 1 shows an over-all arrangement of the electro-hydraulic pulse motor according to one embodiment of the present invention. When electric pulse inputs are fed to an electric pulse motor part 3 through an input 2, rotational outputs from the electric pulse motor part 3 operate a spool 5 of a four way pilot valve part 7 via a reduction gear 4 so as to open the ports of sleeve portion 6 of the valve 7. This is due to the fact that when spool 5 is rotationally operated, it simultaneously receives an axial shift from a screw-nut coupling 13 arranged at the connecting portion of one end of spool 5 and one end of an output shaft 15 of a hydraulic motor part 14 so that land portions 5*a* (three land portions are shown in FIG. 1) of spool 5 displace from a neutral position as shown in FIG. 1.

When the ports of sleeve portion 6 open, the pressurized hydraulic fluid is introduced into hydraulic circuits 10 or 11 from a fluid power source (not shown) through a hydraulic fluid supply passage 8 corresponding to the positive or reverse rotation of electric pulse motor part 3 and the introduced fluid drives hydraulic motor part 14 so as to produce strong rotational output on the output shaft 15. The hydraulic fluid which drives hydraulic motor part 14, returns to the hydraulic power source again through circuits 11 or 10 and a hydraulic fluid return passage 9.

When output shaft 15 of hydraulic motor part 14 rotates, spool 5 again operates by means of screw-nut coupling 13 so as to restore spool 5 to the neutral position where the ports of sleeve 6 of four way pilot valve part 7 are completely closed.

Now, in the electro-hydraulic pulse motor shown in FIG. 1, there are arranged safety valves 1 in the circuits 12*a*, 23*a* and 12*b*, 23*b*, which connect hydraulic fluid supply passage 8 to circuit 10 via sleeve 6 and to circuit 11, respectively, and as a result, violent rise of the hydraulic pressure within circuit 10 or 11 which conventionally occurs based upon the continuation of the positive or reverse inertial rotation of hydraulic motor part 14 after a sudden interruption of the operation of electric pulse motor part 3, is released by safety valves 1 so that the breakage of the hydraulic circuits or the four way pilot valve part as previously explained can be avoided.

The detailed structure and the operation of the safety valve 1 shown in FIG. 1 will be hereinafter explained referring to FIG. 2.

In safety valve 1 assembled in the electro-hydraulic pulse motor, hydraulic fluid supplied from a hydraulic fluid power source (not shown) is introduced into a port 22*a* formed at one end of a cylinder 16 which is fluidly connected to hydraulic fluid supply passage 8 through a circuit 23*a* or 23*b*, while hydraulic fluid in hydraulic circuit 10 or 11 is introduced to a port 22*b* formed at the other end of cylinder 16 and connected to the circuit 10 or 11 through the circuit 12*a* or 12*b*.

A piston 17 is slidably fitted to a cylinder bore 19 of cylinder 16. Seal 18 applied to piston 17 is capable of providing an oil-tight separation between the two sides of fluid supply passage 8 and of hydraulic circuit 10 or 11 as shown in FIG. 2. When the electro-hydraulic pulse motor is in a normally operating state, the hydraulic pressure in the circuit 12*a* or 12*b* is lower than that of hydraulic fluid coming from fluid supply passage 8 and as a result, piston 17 is biased to the side of port 22*b* as shown in FIG. 2 by the difference between the two hydraulic pressures applied to the two end surfaces of piston 17 in addition to the spring force of a spring 12 disposed in cylinder bore 19 so that the ports 22*a* and 22*b* are fluidly disconnected.

Figure 2:
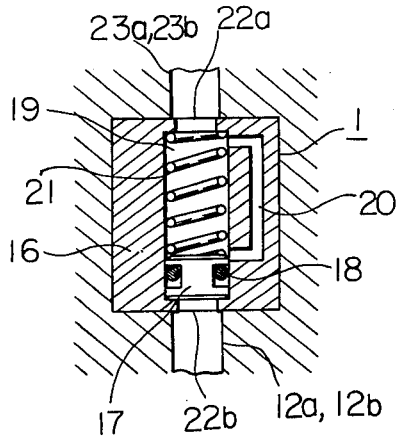
FIG. 2 is a partial and sectional view of a safety valve according to the present invention.

Now assuming that rise of hydraulic pressure in circuit 10 or 11 occurs due to the reason previously explained, the hydraulic pressure at the port 22*b* connected to circuit 10 or 11 also rises and when the pressure becomes high length to overcome the hydraulic pressure at port 22*a* and the spring force of spring 21, piston 17 is forced in the upward direction of FIG. 2, and as a result, a by-pass hydraulic circuit 20 disposed in cylinder 16 with an inlet and an outlet formed in the cylinder wall of cylinder bore 19 provides a fluid connection between both ports 22*a* and 22*b*, and accordingly, between circuit 12*a* or 12*b* and circuit 23*a* or 23*b*. Thus, the sudden high pressure in circuit 12*a* or 12*b* and of course, in circuit 10 or 11 is absorbed and lowered by the hydraulic pressure in circuit 23*a* or 23*b*, because the hydraulic pressure in circuit 22*a* or 23*b* is always adjusted to be in a preselected constant state by the action of the hydraulic power source (not shown) through fluid supply passage 8. As a result breakage of the hydraulic circuits or four way pilot valve part 7 can be completely avoided.

When the hydraulic pressure in circuit 12*a* or 12*b* is lowered, piston 17 returns to the initial position under the action of spring 21.

Now, the release operation of the safety valve according to the present invention will be understood from the above explanation.

Figure 3:
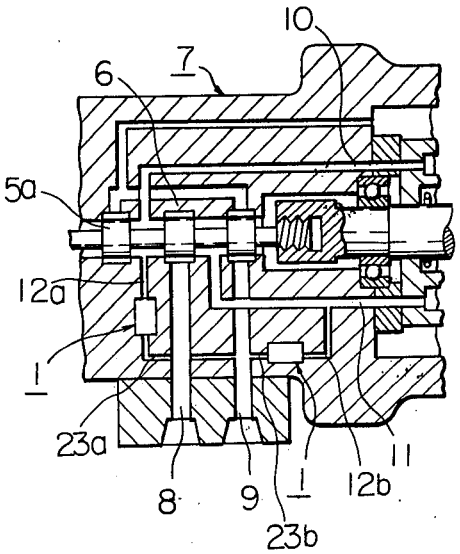
FIG. 3 is a partial and longitudinally sectional view of the electro-hydraulic pulse motor according to another embodiment of the present invention.

FIG. 3 shows another embodiment in which safety valves 1 are connected to the hydraulic fluid return passage 9 of the four way pilot valve part 7.

In this arrangement, circuits 23*a* and 23*b* are connected to fluid return passage 9 where the hydraulic fluid returning from hydraulic motor part 14, is introduced and therefore, in the normal operating state of electro-hydraulic pulse motor of the present invention, the hydraulic pressure at port 22*b* of safety valve 1 is lower than the hydraulic pressure at port 22*a* of safety valve 1 in constrast to the previous embodiment.

However, spring 21 disposed in cylinder bore 19 of safety valve 1 is selected with a stiffness stronger than that of spring 21 in the previous embodiment. This stiffness of spring 21 is selected in relation to the hydraulic pressure drop between ports 22*a* and 22*b*. As a result of this, safety valves 1 of this embodiment having the disposition shown in FIG. 3 offer the same release operation as the previous embodiment shown in FIG. 1. That is to say, the sudden rise of the hydraulic pressure in the circuit 10 or 11 is completely prevented and accordingly breakage of the circuits or four way pilot valve part 14 does not occur.

What is claimed is:

1. An electro-hydraulic pulse motor comprising an electric pulse motor, a rotary pilot valve including a sleeve and a spool, said spool disposed in said sleeve for rotary and slidable movement, an hydraulic motor having an output shaft, hydraulic path means including an oil supply path for supplying pressurized oil to said rotary pilot valve, an oil return path for exhausting return oil from said rotary pilot valve, a pair of hydraulic circuits for leading said pressurized oil from said oil supply path to said hydraulic motor through said rotary pilot valve and for leading said return oil from said hydraulic motor to said oil return path through said rotary pilot valve, the oil pressure in said hydraulic circuits being normally lower than that in said oil supply path, feedback means coupled between said output shaft and said spool for feeding back an axial displacement of said spool when said displacement is produced by said electric pulse motor by rotation of said output shaft, and a first and a second safety valve disposed within said sleeve, said first safety valve being connected between a first of said pair of hydraulic circuits and said oil supply path, said second safety valve being connected between a second of said pair of hydraulic circuits and said oil supply path, each of said safety valves including a cylinder provided with a cylinder bore having a wall, one end of each said cylinder bore connected to said oil supply path, the other end of each said cylinder bore connected to a respective hydraulic circuit, for each said safety valve an oil-type piston slidably fitted in said cylinder bore and having first and second end surfaces respectively facing said one end and said other end of said cylinder bore whereby said pressurized oil is applied to said first end surface and the normally lower pressure of the oil in a respective hydraulic circuit is applied to said second end surface, a spring disposed in each said cylinder bore for supplying a spring force to said piston first end surface thereby providing a biasing force in addition to the pressure of said pressurized oil for biasing said piston toward said other end of said cylinder bore to a normal initial position, an hydraulic bypass circuit for each cylinder having an inlet and an outlet both formed in said wall of said cylinder bore for fluidly connecting a respective hydraulic circuit to said oil supply path only when said piston is displaced from said initial position by a predetermined rise in the oil pressure in the respective hydraulic circuit.

2. The electro-hydraulic pulsemotor of claim 1 in which the spring force of said spring is selected to correspond to the difference between said predetermined rise of the oil pressure in a respective hydraulic circuit with respect to the pressure of said pressurized oil of said oil supply path.

* * * * *

UNITED STATES PATENT OFFICE

CERTIFICATE OF CORRECTION

PATENT NO. : 4,031,811

DATED : June 28, 1977

INVENTOR(S) : S. Inaba et al

It is certified that error appears in the above-identified patent and that said Letters Patent are hereby corrected as shown below:

On the title page, change "The portion of the term of this patent subsequent to May 28, 1992 has been disclaimed." to --The portion of the term of this patent subsequent to July 28, 1992 has been disclaimed.--

Signed and Sealed this

*Ninth* Day of *May 1978*

[SEAL]

*Attest:*

RUTH C. MASON
*Attesting Officer*

LUTRELLE F. PARKER
*Acting Commissioner of Patents and Trademarks*